US011517159B2

(12) United States Patent
Kim

(10) Patent No.: US 11,517,159 B2
(45) Date of Patent: Dec. 6, 2022

(54) CLEANER

(71) Applicant: SAMSUNG ELECTRONICS CO., LTD., Suwon-si (KR)

(72) Inventor: Byung Chan Kim, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 143 days.

(21) Appl. No.: 16/763,466

(22) PCT Filed: Sep. 27, 2018

(86) PCT No.: PCT/KR2018/011427
§ 371 (c)(1),
(2) Date: May 12, 2020

(87) PCT Pub. No.: WO2019/093655
PCT Pub. Date: May 16, 2019

(65) Prior Publication Data

US 2020/0352403 A1 Nov. 12, 2020

(30) Foreign Application Priority Data

Nov. 13, 2017 (KR) ..... 10-2017-0150912

(51) Int. Cl.
*A47L 9/04* (2006.01)
*A47L 9/00* (2006.01)
*A47L 9/28* (2006.01)

(52) U.S. Cl.
CPC ..... *A47L 9/0477* (2013.01); *A47L 9/009* (2013.01); *A47L 9/2826* (2013.01);
(Continued)

(58) Field of Classification Search
CPC ..... A47L 9/009; A47L 9/0477; A47L 9/2826; A47L 9/2852; A47L 9/2889; A47L 11/18; A47L 11/4041; A47L 2201/04
(Continued)

(56) References Cited

U.S. PATENT DOCUMENTS 10,729,297 B2 * 8/2020 Klintemyr ..... A47L 9/0472
2004/0187254 A1 9/2004 Fedorka et al.
(Continued)

FOREIGN PATENT DOCUMENTS

CN 1387411 A 12/2002
CN 1980594 A 6/2007
(Continued)

OTHER PUBLICATIONS

Chinese Office Action dated Sep. 18, 2021 from Chinese Application No. 201880073226.0.
(Continued)

*Primary Examiner* — Michael D Jennings
*Assistant Examiner* — Aaron R McConnell
(74) *Attorney, Agent, or Firm* — Staas & Halsey LLP

(57) ABSTRACT

Provided is a cleaner having improved cleaning efficiency. The cleaner includes a main body having a intake provided to suction an object to be cleaned and a suction device having a brush chamber that communicates with the intake and a brush accommodated in the brush chamber, wherein the brush includes a brush body rotatably coupled to the brush chamber, a blade protruding in a radial direction of the brush body, and prevention members formed to be inclined from a central portion of the brush body to opposite side ends of the brush body to prevent foreign substance introduced into the brush chamber from being wound around the blade.

15 Claims, 8 Drawing Sheets

(52) U.S. Cl.
CPC ..... *A47L 9/2852* (2013.01); *A47L 9/2889* (2013.01); *A47L 2201/04* (2013.01)

(58) Field of Classification Search
USPC ..... 15/383
See application file for complete search history.

(56) References Cited

U.S. PATENT DOCUMENTS

| | | | | |
|---|---|---|---|---|
| 2008/0276407 | A1* | 11/2008 | Schnittman | A47L 11/4066 901/1 |
| 2009/0229075 | A1* | 9/2009 | Eriksson | A46B 13/006 15/48 |
| 2014/0259475 | A1* | 9/2014 | Doughty | A47L 11/4072 15/207.2 |
| 2016/0015233 | A1* | 1/2016 | Uphoff | A47L 9/0455 134/6 |
| 2016/0278595 | A1 | 9/2016 | Shim et al. | |

FOREIGN PATENT DOCUMENTS

| | | |
|---|---|---|
| CN | 102727136 A | 10/2012 |
| CN | 102961088 | 3/2013 |
| CN | 205514379 | 8/2016 |
| CN | 106659345 | 5/2017 |
| EP | 0 313 403 | 4/1989 |
| EP | 0 898 926 | 3/1999 |
| FR | 2 999 067 | 6/2014 |
| JP | 5-88467 | 12/1993 |
| KR | 10-2011-0125942 | 11/2011 |
| KR | 10-2013-0025309 | 3/2013 |
| KR | 10-1644887 | 8/2016 |
| KR | 10-2017-0049532 | 5/2017 |
| WO | 2016/037635 | 3/2016 |

OTHER PUBLICATIONS

Extended European Search Report dated Nov. 23, 2020 from European Application No. 18875210.9, 8 pages.
Chinese Office Action dated Apr. 1, 2021 from Chinese Application No. 201880073226.0, 21 pages.
International Search Report dated Jan. 29, 2019, in corresponding International Patent Application No. PCT/KR2018/011427.
Korean Office Action dated Jan. 25, 2022 from Korean Application No. 10-2017-0150912.
Chinese Office Action dated Feb. 23, 2022 from Chinese Application No. 201880073226.0.
Korean Office Action dated Jul. 4, 2022 for Korean Application No. 10-2017-0150912.
Korean Office Action dated Oct. 17, 2022 for Korean Application No. 10-2017-0150912.

* cited by examiner

CLEANER

CROSS-REFERENCE TO RELATED APPLICATIONS

This application is a U.S. National Stage Application which claims the benefit under 35 U.S.C. § 371 of International Patent Application No. PCT/KR2018/011427 filed on Sep. 27, 2018, which claims foreign priority benefit under 35 U.S.C. § 119 of Korean Patent Application No. 10-2017-0150912 filed on Nov. 13, 2017 in the Korean Intellectual Property Office, the contents of both of which are incorporated herein by reference.

TECHNICAL FIELD

The disclosure relates to a cleaner, and more specifically, to a cleaner having improved cleaning efficiency.

BACKGROUND ART

A cleaner is a device that cleans an indoor space by removing objects to be cleaned indoors, and a vacuum cleaner may be generally used at home.

A vacuum cleaner is a household appliance that keeps the indoor space clean by suctioning air using the suction power of a blower and then separating the objects to be cleaned from the suctioned air using a device, such as a filter.

The vacuum cleaner may include a general vacuum cleaner that is provided with a handle with which the vacuum cleaner is directly moved by a user to suction the object to be cleaned on the floor.

The vacuum cleaner may include a robot cleaner that drives on an area to be cleaned according to a preset program without user manipulation and performs cleaning by suctioning the object to be cleaned on the floor.

In general, the robot cleaner detects a distance to an obstacle, such as furniture, office supplies, or a wall installed in the cleaning area through various sensors, and drives while avoiding collision with the obstacle using the detected information and cleans the cleaning area.

The vacuum cleaner includes a brush disposed at an intake on which the suction power of a blower is exerted, and allows the object to be cleaned on the floor to be swept upward by the rotating brush, so that the object to be cleaned is more easily suctioned through the intake The brush is rotatively is operated, and in order to increase the cleaning performance of the vacuum cleaner, required to have high speed and friction. Accordingly, the brush is likely to be wound by the object to be cleaned, such as hair, animal hair, thread, and the like, and foreign substance, such as wires, clothes, rugs of carpets.

When the object to be cleaned or the foreign substance is wound around the brush, rotation of the brush is restricted by the object to be cleaned or foreign substance, which may cause the brush to be inoperable or completely lose the cleaning function.

DISCLOSURE

Technical Problem

Therefore, it is an object of the disclosure to provide a cleaner with improved cleaning performance.

It is another object of the disclosure to provide a cleaner improved to block foreign substance from entering a brush chamber.

It is another object of the disclosure to provide a cleaner improved to prevent the cleaning efficiency from being lowered due to the object to be cleaned or foreign substance being wound around a brush.

It is another object of the disclosure to provide a cleaner improved to remove the object to be cleaned being wound around the brush from the brush.

Technical Solution

According to an aspect of the disclosure, there is provided a cleaner including: a main body having a intake provided to suction an object to be cleaned; and a suction device having a brush chamber that communicates with the intake and a brush accommodated in the brush chamber, wherein the brush includes a brush body rotatably coupled to the brush chamber, a blade protruding in a radial direction of the brush body, and prevention members formed to be inclined from a central portion of the brush body to opposite side ends of the brush body to prevent foreign substance introduced into the brush chamber from being wound around the blade.

The prevention members may be spaced apart from the blade at a same distance along a longitudinal direction of the brush body.

The prevention members may be arranged along a rotation direction of the brush body from the central portion of the brush body to longitudinal direction opposite sides of the brush body.

The prevention members may protrude in the radial direction of the brush body at a height smaller than a height of the blade protruding in the radial direction of the brush body.

The prevention members may be arranged bilaterally symmetrical to the central portion of the brush body.

The blade may include a plurality of blades spaced apart from each other, and the prevention members may be arranged at a same distance from the blades arranged at opposite sides of the prevention members among the plurality of blades.

The prevention members may be formed of material having a rigidity greater than a rigidity of material forming the blade.

The prevention members may be formed of same material as material forming the brush body.

The cleaner may further include a brush base configured to cover a lower portion of the brush chamber to guide air to the intake, and the brush base may include a blocking member having an inclined portion that is configured to block foreign substance from being introduced into the brush chamber.

The blocking member may include a plurality of blocking member spaced apart from each other, and the inclined portions of the blocking members adjacent to each other among the plurality of blocking members are inclined in a same direction. The inclined portions of the blocking members adjacent to each other among the plurality of blocking members may be spaced apart from each other at a constant interval along a direction from a front surface of the brush base to a rear surface of the brush base.

The suction device may further include a friction member arranged on the brush chamber to separate an object to be cleaned being wound around the blade using a frictional force of contacting with the blade.

The friction member may be arranged above the intake while being adjacent to the intake.

The friction member may be arranged along a longitudinal direction of the brush body.

The friction member may be arranged between the intake and a rotation shaft of the brush body.

Advantageous Effects

As is apparent from the above, the disclosure can prevent the cleaning efficiency of the cleaner from being lowered due to foreign substance.

The disclosure cleaner can improve the cleaning efficiency of the cleaner by blocking foreign substance from entering a brush chamber.

The disclosure can improve the cleaning efficiency of the cleaner by preventing objects to be cleaned or foreign substance from being wound around on a brush.

The disclosure can improve the cleaning efficiency of the cleaner by separating objects to be cleaned being wound around the brush using a friction force.

BEST MODES OF THE DISCLOSURE

Modes of the Disclosure

Figure 1:
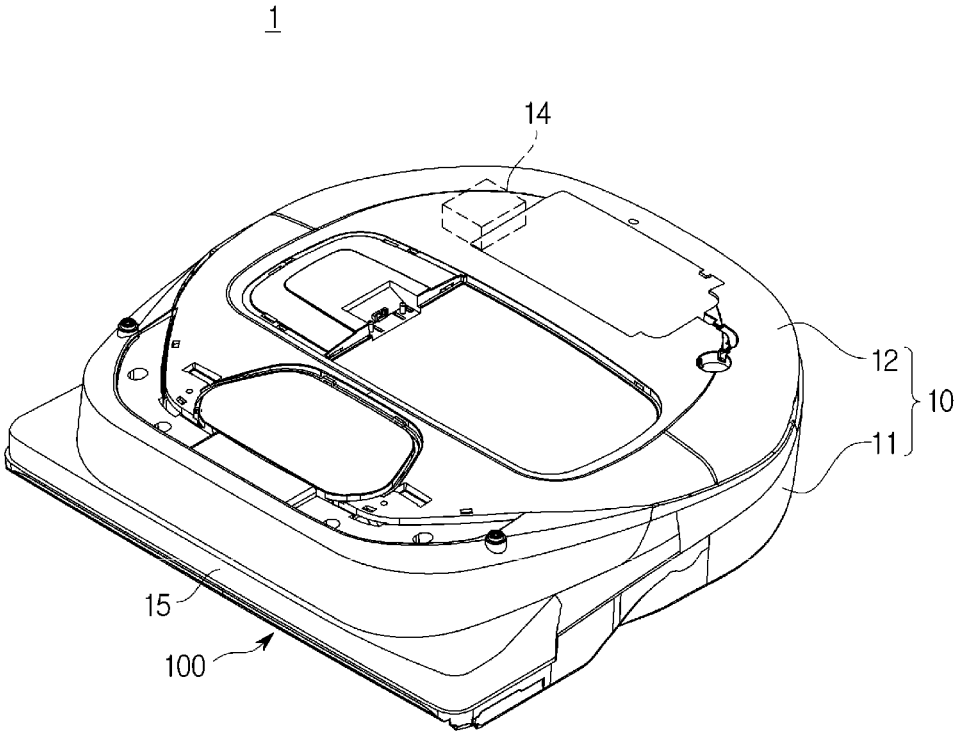
FIG. 1 is a perspective view illustrating a cleaner according to the disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions. The terms used herein are for the purpose of describing the embodiments and are not intended to restrict and/or to limit the present disclosure.

For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

Thus, it does not preclude the existence or addition possibility of one or more other features or numbers, steps, operations, components, parts or combinations thereof.

In addition, it will be understood that, although the terms first, second, etc. may be used herein to describe various components, these components should not be limited by these terms. These terms are only used to distinguish one component from another.

For example, without departing from the scope of the present disclosure, the first component may be referred to as a second component, and similarly, the second component may also be referred to as a first component. The term "and/or" includes any combination of a plurality of related items or any one of a plurality of related items.

Hereinafter, embodiments of the present disclosure will be described in detail with reference to the accompanying drawings.

Figure 2:
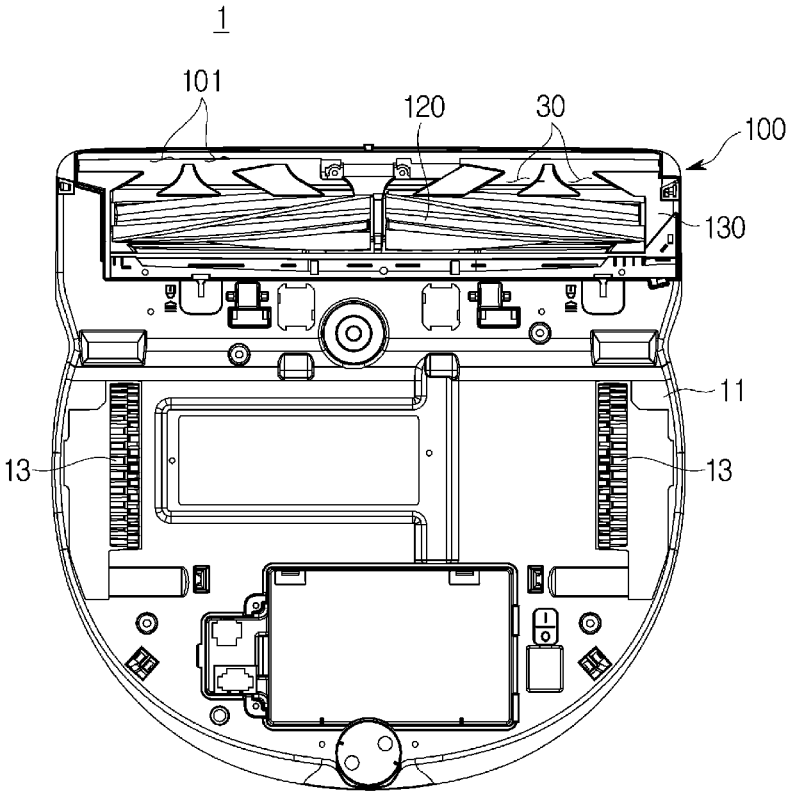
FIG. 2 is a view illustrating the bottom surface of the cleaner according to the disclosure.
Figure 3:
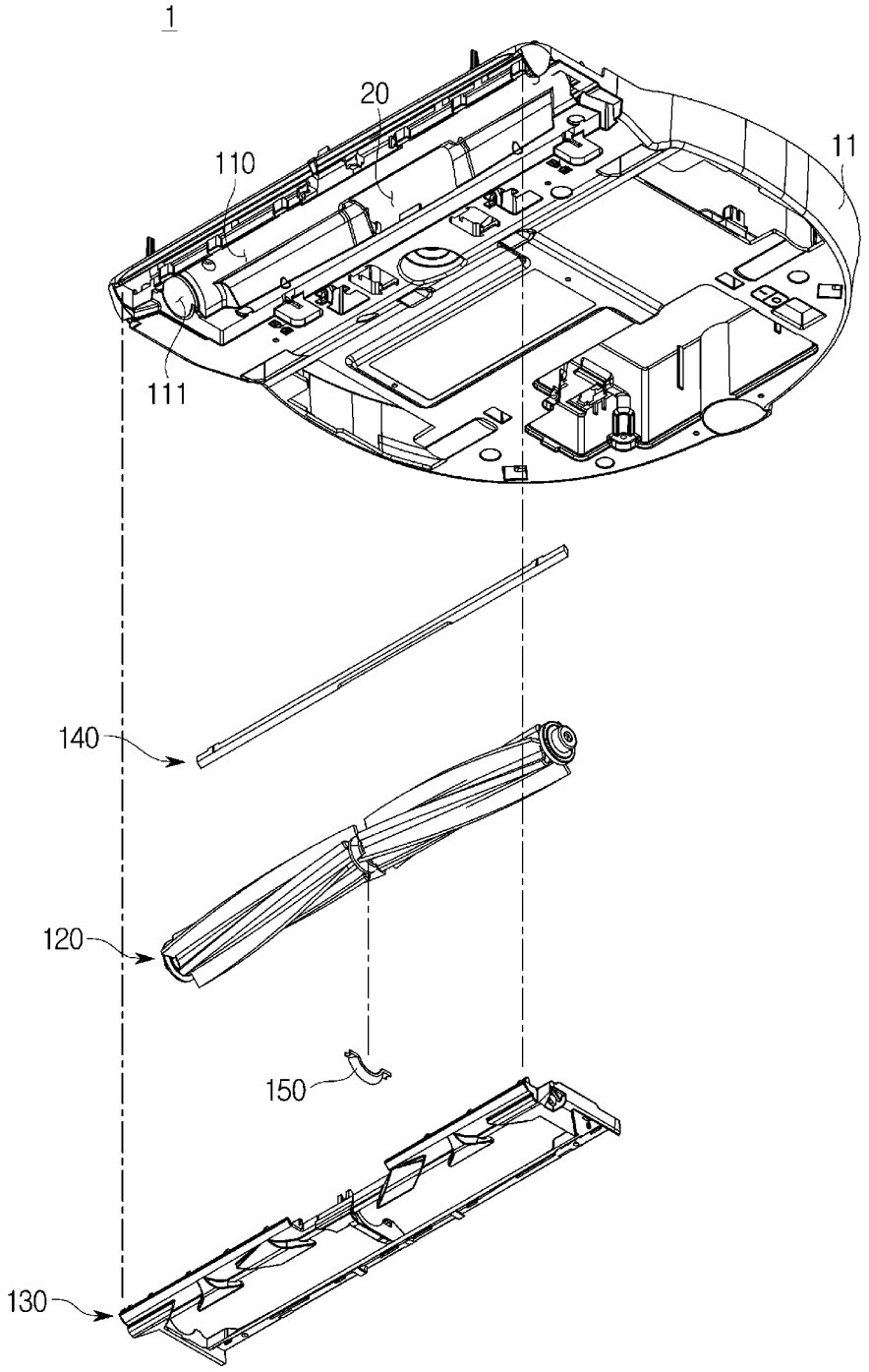
FIG. 3 is a view illustrating the cleaner according to the disclosure, in which a suction device is disassembled.

FIG. 1 is a perspective view illustrating a cleaner according to the disclosure. FIG. 2 is a view illustrating the bottom surface of a cleaner according to the disclosure. FIG. 3 is a view illustrating a cleaner according to the disclosure, in which a suction device is disassembled.

Referring to FIGS. 1 to 3, a cleaner 1 according to the disclosure may include a robot cleaner. However, the disclosure is not limited thereto, and for example, the cleaner 1 according to the disclosure may include a canister type cleaner, an upright type cleaner, or a stick type cleaner.

The cleaner 1 according to the disclosure may include a main body 10 forming the external appearance and wheels 13 provided to allow the main body 10 to drive in a cleaning area.

The main body 10 may be provided to form the external appearance of the cleaner 1 and support various parts installed therein. The main body 10 may have various shapes, and the main body 10 may have a quadrangular shape or a circular shape.

When the main body 10 is formed in a quadrangular shape, the cleaner 1 may clean an edge area connecting one wall to another wall.

When the main body 10 is formed in a circular shape, the main body 10 even at a time of rotation may be prevented from coming into contact with surrounding obstacles due to having a constant radius of rotation, and may easily perform direction change. In addition, the main body 10 is prevented from being stuck due to being caught by surrounding obstacles while on the drive.

The following description will be made on an example of the main body 10 having a front side formed in a square shape and a rear side in a circular shape according to an embodiment of the disclosure.

The main body 10 may include an intake 20. Although not shown in the drawings, a blower (not shown) generating suction force is provided inside the main body 10 such that air and objects to be cleaned being introduced through the intake 20 are moved to a dust collecting device (not shown) in which objects to be cleaned are collected.

The main body 10 may include a base 11 forming a bottom and a cover 12 forming an upper surface of the base 11. The wheels 13 may be bilaterally symmetrically installed on the left and right sides of the base 11. The wheel 13 may be provided to be powered by a driving motor (not shown) so that the main body 10 may drive on a cleaning area.

A controller 14 is provided inside the main body 10 to control the operation of the cleaner 1. The controller 14 may control the wheels 13 to control the drive of the cleaner 1.

The cleaner 1 may be provided with a bumper 15 for absorbing external shocks while driving. The bumper 15 may be provided at the front or rear of the cleaner 1. In the embodiment of the disclosure, the bumper 15 is illustrated as being installed on the front surface of the cleaner 1 as an example, but the spirit of the disclosure is not limited thereto.

The cleaner 1 may include a sensor (not shown). The sensor (not shown) may be provided to detect obstacles or walls. At least one sensor (not shown) may be installed.

The sensor (not shown) may include at least one of an infrared sensor, an ultrasonic sensor, or a touch sensor. The sensor (not shown) may be disposed on a front or a lateral side of the body 10.

A display device (not shown) may be installed on the main body 10, and the display device (not shown) may provide the user of information related to the state or operation of the cleaner 1.

An inputter (not shown) may be provided on the upper surface of the cover 12. The inputter (not shown) may allow a user to input a command to control the cleaner 1.

The inputter (not shown) may be a button that is pressed by a user to input a command, and may be provided as a touch screen that is touched by a user to input a command (not shown). The user may input a command to the cleaner 1 using a remote controller instead of an inputter (not shown).

The cleaner 1 may include a suction device 100 that forms a front surface of the exterior appearance of the cleaner 1. The cleaner 1 according to the disclosure shown in FIG. 1 is illustrated as having the suction device 100 and the main body 10 integrally formed with each other.

However, the disclosure is not limited thereto, and the suction device 100 and the main body 10 may be provided separately and coupled to each other.

The suction device 100 may be provided to suction the object to be cleaned on the floor together with air through the suction force. Here, the object to be cleaned may refer to a target object that is relatively small in volume, such as dust, hair, animal hair or thread, and is intended to be removed through the cleaner 1.

The suction device 100 may communicate with the intake 20 formed in the front of the main body 10. The suction device 100 may be provided at a bottom surface thereof with an inlet 101 for suctioning objects to be cleaned, such as air, dust, and the like. The inlet 101 may communicate with the intake 20. The inlet 101 and the intake 20 communicating with each other may form a suction passage 30.

The air and the object to be cleaned being suctioned through the inlet 101 may be introduced into the dust collecting device (not shown) of the main body 10 through the intake 20. The inlet 101 may be provided in a substantially rectangular shape.

The suction device 100 may be provided with a brush 120 provided to sweep the object to be cleaned on the floor upward. The suction device 100 may include a brush chamber 110 forming an accommodation space of the brush 120 so that the brush 120 is installed therein.

The brush 120 may have a substantially cylindrical shape, and the brush chamber 110 may be formed in a semicircular shape to correspond to the shape of the brush 120. The brush 120 may be rotatably installed inside the brush chamber 110.

The brush chamber 110 may communicate with the intake 20. The brush 120 may be detachably provided on the brush chamber 110.

The brush chamber 110 may include an accommodating portion 111 to which the brush 120 is coupled. The accommodating portion 111 may be provided to allow the brush 120 to pass therethrough. That is, the diameter of the accommodating portion 111 may be larger than or equal to the diameter of the brush 120.

The suction device 100 may include a brush base 130 that is detachably provided on the lower portion of the brush chamber 110 to cover the brush chamber 110.

The brush 120 is rotatively operated, and in order to increase the cleaning performance of the cleaner 1, required to have high speed and friction. Accordingly, the brush 120 is likely to be wound by the object to be cleaned, such as hair, animal hair, thread, and the like, and foreign substances, such as wires, clothes, rugs of carpets.

Here, the foreign substance refers to an object that is relatively large in volume, unlike the object to be cleaned, and an object that is not a target to be removed through the cleaner 1.

When the object to be cleaned or the foreign substance is wound around the brush 120, an overcurrent may flow through a brush motor (not shown), and a temperature increase of the brush motor (not shown) may occur.

In addition, the brush 120 may be restricted by the object to be cleaned or foreign substance, causing the driving to be inoperable, or the cleaning function of the cleaner 1 to be completely lost.

Accordingly, the suction device 100 of the vacuum cleaner 1 according to the disclosure may allow the performance of the brush 120 to be kept constant through a mechanical configuration or electronic control.

Hereinafter, the mechanical configuration of the suction device 100 for maintaining the cleaning performance of the cleaner 1 will be described in detail.

Figure 4:
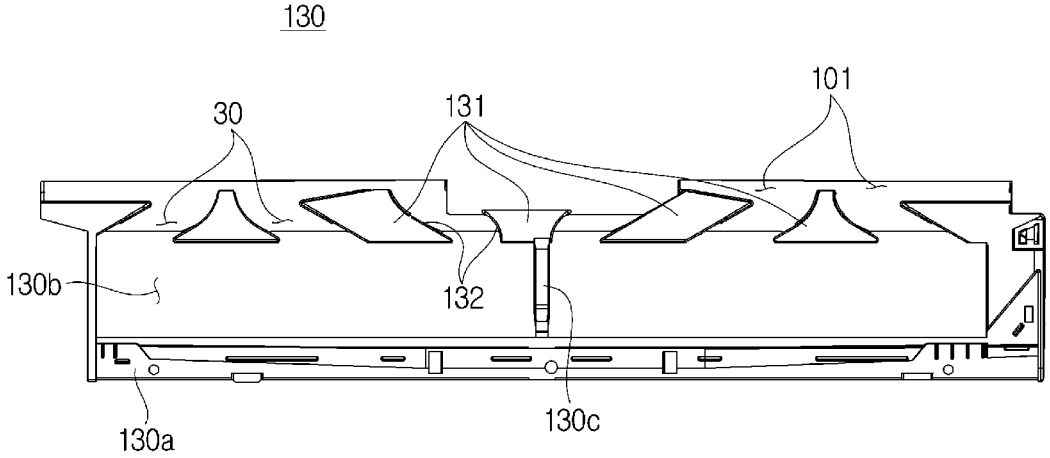
FIG. 4 is a view illustrating the cleaner according to the disclosure, which shows a brush base.

FIG. 4 is a view illustrating a brush base 130 in the cleaner according to the disclosure. Referring to FIG. 4, the brush base 130 may include a base frame 130*a*. The base frame 130*a* may include a space portion 130*b* through which the brush (120 in FIG. 3) may pass to come into contact with the floor. The brush 120 may come into contact with the floor through the space portion 130*b* of the base frame 130*a* to draw the object to be cleaned on the floor by rolling.

The base frame 130*a* may be formed in a substantially quadrangular ring shape, and the brush base 130 may include a connecting portion 130*c* extending inward from the base frame 130*a* to partition the space portion 130*b*. The brush base 130 may be formed in a substantially lattice shape by the connecting portion 130*c*.

Due to the characteristics of the vacuum cleaner 1, such as a robot cleaner, the thickness of the base frame 130*a* may be limited, and the connecting portion 130*c* may reinforce the rigidity of the brush base 130 when injection molding the brush base 130.

In addition, the connecting portion 130*c* may prevent a relatively large foreign substance, such as an electric wire, from being introduced into the brush chamber 110.

A blocking member 131 may be provided on the base brush 130 to form the suction passage 30. The blocking member 131 may be disposed at a lower portion of the base brush 130. The blocking member 131 may be disposed in front of the base frame 130*a*. The blocking member 131 may be disposed behind the inlet 101.

The blocking member 131 may be provided to guide the suctioned air into the intake 20. A plurality of the blocking members 131 may be spaced apart from each other. The blocking member 131 may include an inclined portion 132.

The blocking member 131 includes the inclined portion 132 to form the suction passage 30 to guide the suctioned air into the intake 20. Accordingly, the cleaning performance of the cleaner 1 may be improved.

The inclined portion 132 may block foreign substances from being introduced into the brush chamber (110, FIG. 3). The inclined portions 132 of the blocking members 131 adjacent to each other may be inclined in the same direction.

That is, the plurality of blocking members 131 may have surfaces facing each other that are inclined in the same direction.

Due to the inclined portions 132, the suction passage 30 forms a slope rather than a straight line from the front side of the cleaner 1 to the rear side of the cleaner 1, so that relatively large foreign substance, such as an electric wire, is blocked from being introduced into the brush chamber 110.

The inclined portions 132 of the blocking members 131 adjacent to each other may be spaced apart at regular intervals along a direction from the front to the rear of the brush base 130.

Although the blocking member 131 of the cleaner 1 according to the disclosure is illustrated as having an approximately parallelogram shape, the spirit of the disclosure is not limited thereto.

The blocking member 131 may be provided in various shapes as long as it can guide the air and the object to be cleaned in front of the cleaner 1 toward the intake 20, and block relatively large foreign substances from being introduced into the brush chamber 110.

The distance between the inclined portions 132 of the blocking members 131 adjacent to each other at the same point along the direction from the front to the rear of the brush base 130 may be preferably about 15 mm or more. However, the disclosure is not limited thereto.

The minimum distance between the inclined portions 132 of the blocking members 131 adjacent to each other along the direction from the front to the rear of the brush base 130 may be preferably about 6 mm or more. However, the disclosure is not limited thereto.

Accordingly, the cleaner 1 according to the disclosure may allow the blocking member 131 and the connecting portion 130*c* to primarily block relatively large foreign substance, such as an electric wire, from being introduced into the brush chamber 110.

Figure 5:
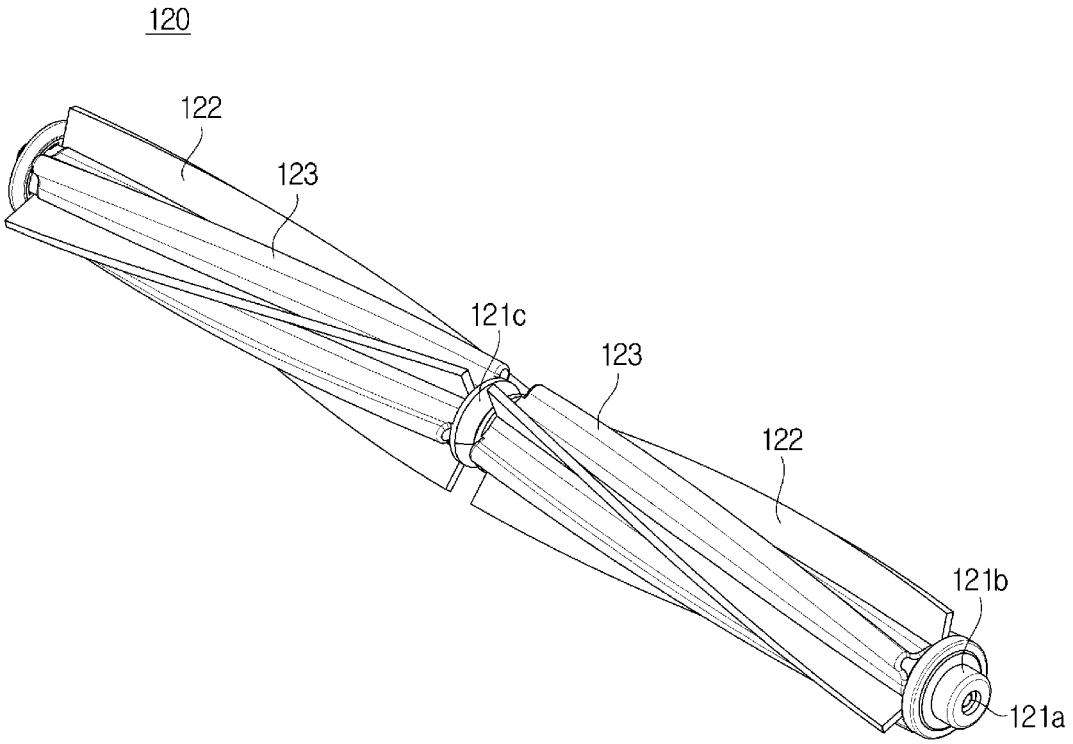
FIG. 5 is a view illustrating the cleaner according to the disclosure, which shows a brush.
Figure 6:
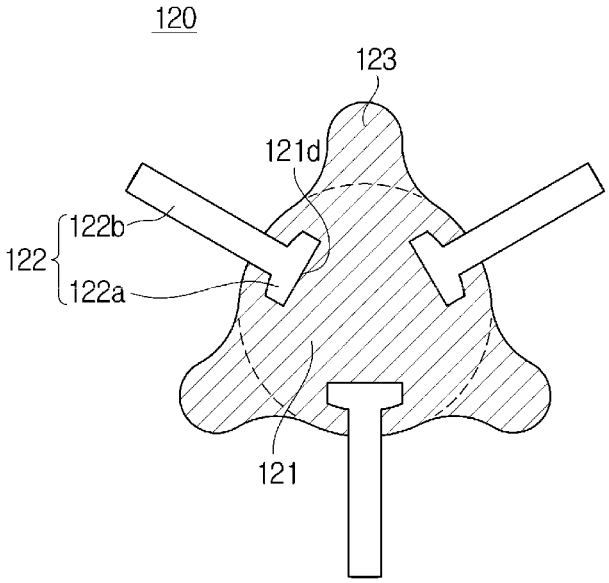
FIG. 6 is a view illustrating the cleaner according to the disclosure, which shows a cross section of a brush.

FIG. 5 is a view illustrating the cleaner according to the disclosure, which shows a brush. FIG. 6 is a view illustrating the cleaner according to the disclosure, which shows a cross section of a brush. Referring to FIGS. 5 and 6, the brush 120 may include a brush body 121 rotatably coupled to the brush chamber (110, FIG. 3).

The brush body 121 may be formed of a rigid body and have a substantially cylindrical shape, and may be rotatably coupled to the brush chamber 110 around a rotation shaft 121*a* and driven by the brush motor (not shown).

The brush 120 may be provided with coupling portions 121*b* at both ends of the brush body 121 so as to be accommodated in the accommodating portion (111 in FIG. 3). The brush motor (not shown) may be connected to one of the coupling portions 121*b*, and a bearing (not illustrated) may be provided on the other one of the coupling portion 121*b*.

The brush body 121 may be provided as a unitary body. However, the disclosure is not limited thereto, and the brush body 121 may be provided in plural. The brush body 121 is provided at a central portion thereof with a groove portion 121*c* in which the connecting portion (130*c* in FIG. 4) of the brush base 130 is positioned.

However, since a gap may exist between the groove portion 121*c* and the connecting portion 130*c*, an object to be cleaned having a relatively small in volume, such as hair, may be caught between the groove portion 121*c* and the connecting portion 130*c*.

Accordingly, the suction device 100 may include a grinder (150 in FIG. 3) that is disposed opposite to an outer circumferential surface of the groove portion 121*c* and crushes the object to be cleaned caught in the groove portion 121*c*. The grinder 150 may be disposed on the lower side of the groove portion 121*c* while being fixed to the upper side of the connecting portion 130*c*.

The grinder 150 is formed in a curved fan-shaped shape in which the central portion is cut to correspond to the outer circumferential surface of the groove portion 121*c* formed in a truncated cone shape, so that the inner circumferential surface of the grinder 150 faces the groove portion 121*c*.

The grinder 150 protrudes from the inner circumferential surface thereof toward the groove portion 121*c* while being spaced apart from the outer circumferential surface of the groove portion 121*c* at a predetermined interval to crush the object to be cleaned.

Accordingly, the object to be cleaned, such as hair, flowing into the space between the groove portion 121*c* and the grinder 150 according to the rotation of the brush 120 is crushed or cut after being caught by the grinder 150 while rotating with the brush 120, and then is suctioned into the intake 20 together with air by the suction force acting on the intake 20.

The brush 120 may include a blade 122 provided on the outer circumferential surface of the brush body 121 and protruding from the brush body 121. The blade 122 may protrude from the brush body 121 in a radial direction of the brush body 121.

The blade 122 may be coupled to the brush body 121. While the cleaner 1 is driving, the blade 122 may stir dust or debris accumulated on the floor by being operated together with the brush body 121.

The blade 122 may have a length substantially similar to that of the brush body 121. One blade 122 may be disposed along the longitudinal direction of the brush body 121, or a plurality of blades 122 may be disposed along the longitudinal direction of the brush body 121.

The blade 122 may be provided at one end thereof with a blade coupling portion 122*a* that is coupled and fixed to a blade groove 121*d* of the brush body 121. As the blade coupling portion 122*a* is coupled to the blade groove 121*d*, the blade 122 may be coupled and fixed to the brush body 121.

The blade 122 may be provided such that a portion of the other end opposite to the blade coupling portion 122*a* comes into contact with the surface to be cleaned, so as to beat the surface to be cleaned. Accordingly, the object to be cleaned on the surface to be cleaned may be scattered and guided to the interior of the cleaner 1 through the intake 20.

The blade 122 may be provided in plural along the rotational direction of the brush body 121. The plurality of blades 122 may be spaced apart from each other. The distance between the plurality of blades 122 may be the same. However, the disclosure is not limited thereto.

In FIGS. 5 and 6, the blade 122 is provided as three blades 122, and the blade groove 121*d* is provided as three blade grooves 121*d* corresponding in number to the number of blades 122, but the number of the blades 122 and the blade grooves 121*d* are not limited thereto, and may be provided in various ways.

For example, only one blade groove 121*d* and one blade 122 may be provided to correspond to each other.

The blade 122 may be extended in a spiral shape in which a portion thereof adjacent to a side end of the brush body 121 is located at a rotational direction front side of the brush body 121 and a portion thereof adjacent to a central portion of the brush body 121 is located at a rotational direction rear side of the brush body 121.

That is, the blade 122 may be provided obliquely with respect to the longitudinal direction of the brush body 121. The blade 122 may be arranged to be headed in the rotational direction of the brush body 121 as being directed toward the opposite sides in the longitudinal direction of the brush body 121 from the central portion of the brush body 121.

The blades 122 may be disposed on the brush body 121 to be inclined toward opposite ends of the brush body 121 from the central portion of the brush body 121 and bilaterally symmetrical about the central portion of the brush body 121.

Accordingly, when the brush 120 is viewed in the radial direction of the brush 120, the blade 122 may be arranged in a substantially 'V' shape with respect to the brush body 121.

When the blade 122 is arranged in a substantially 'V' shape with respect to the brush body 121, the intake (20 in FIG. 3) communicating with the dust collecting device (not shown) is provided at an approximately central portion of the brush chamber (110 in FIG. 3), so that objects present on the opposite sides in the longitudinal direction may be guided to the central portion of the brush body 121 to be efficiently suctioned into the intake 20.

The blade 122 may include a nozzle formed of an elastic material, or a bristle formed of a brush. However, the disclosure is not limited thereto.

The blade 122 formed of a bristle or a brush may effectively prevent the object, such as fibrous dust, from being entangled with the blade 122, when compared to a case where the blade 122 is formed of an elastic material.

When the blade 122 includes a nozzle having an elastic material, the blade 122 may include a blade hole (an air current hole (not shown)) formed in the blade body 122*b* that guides the object to be cleaned into the interior of the cleaner 1.

The blade hole (not shown) may have a circular shape, and may be provided in plural along the longitudinal direction of the brush body 121.

The blade hole (not shown) may reduce the contact area between the blade 122 and the surface to be cleaned, thereby reducing the resistance between the blade 122 and the surface to be cleaned, thereby improving the cleaning efficiency.

The blade hole (not shown) may reduce noise caused by friction between the blade 122 and the surface to be cleaned, and reduce the resistance between the blade 122 and the surface to be cleaned, thereby reducing the driving power for rotating the blade 122 and thus reducing the power consumption.

The brush 120 includes a prevention member 123 protruding in the radial direction of the brush body 121 from the brush body 121 to prevent foreign substance flowing into the brush chamber 110 from being wound around the blade 122.

The prevention member 123 may be spaced apart from the blade 122 at the same interval along the longitudinal direction of the brush body 121. The prevention member 123 may be provided in a length substantially similar to the length of the brush body 121.

The prevention member 123 may extend with the same inclination as that of the blade 122 while being spaced apart from the blade 122. That is, the prevention member 123 may be arranged along the rotational direction of the brush body 121 from the central portion to the opposite sides of the brush body 121 in the longitudinal direction of the brush body 121.

The prevention member 123 may be inclined from the central portion to the opposite ends of the brush body 121, and the prevention members 123 may be bilaterally symmetrical about the central portion of the brush body 121.

The prevention member 123 may be disposed between the plurality of blades 122. The prevention member 123 is disposed at the same interval from each of the blades 122 disposed on the opposite sides of the prevention member 123. However, the disclosure is not limited thereto.

The material of the prevention member 123 may be harder than the material of the blade 122. Accordingly, the prevention member 123 formed of a relatively hard material may prevent foreign substance from being wound on the blade 122.

The prevention member 123 may be formed of the same material as that of the brush body 121. The prevention member 123 may be integrally formed with the brush body 121. However, the disclosure is not limited thereto, and the prevention member 123 may be provided separately from the brush body 121 and may be coupled thereto.

The height at which the prevention member 123 protrudes in the radial direction of the brush body 121 may be smaller than the height at which the blade 122 protrudes in the radial direction of the brush body 121.

Because the prevention member 120 protrudes at a height smaller than that of the blade 122, when the prevention member 123 formed of material harder than that of the blade 122 and the blade 122 come contact with the floor surface, noise occurrence is prevented and an impact is prevented from being applied to the prevention member 123.

Although the prevention member 123 is illustrated as having an approximately semi-cylindrical shape in FIGS. 5 and 6, the disclosure is not limited thereto. For example, the prevention member 123 may be provided in various ways as long as foreign substance introduced into the brush chamber (110 in FIG. 3) is prevented from being wound around the blade 122.

The prevention member 123 may be provided in plural along the rotational direction of the brush body 121. The plurality of prevention members 123 may be spaced apart from each other. The plurality of prevention members 123 may be spaced apart from each other at the same distance between each other. However, the disclosure is not limited thereto.

Although three blades 122 and three prevention members 123 disposed between the three blades 122 are illustrated in FIGS. 5 and 6, the arrangement and the number of the blades 122 and the prevention members 123 are not limited thereto.

That is, the blade 122 and the prevention member 123 may be irregularly arranged along the outer circumferential direction of the brush body 121, and the number of the blades 122 and the number of the prevention members 123 may be provided to be different from each other.

Accordingly, the cleaner 1 according to the disclosure may allow the prevention member 123 to prevent foreign substance flowing into the brush chamber 110 from being wound around the blade 122, and allow the grinder 150 to crush relatively small objects to be cleaned, such as hair wound on the groove portion 121*c*, so that the cleaning performance of the cleaner 1 may be maintained.

Figure 7:
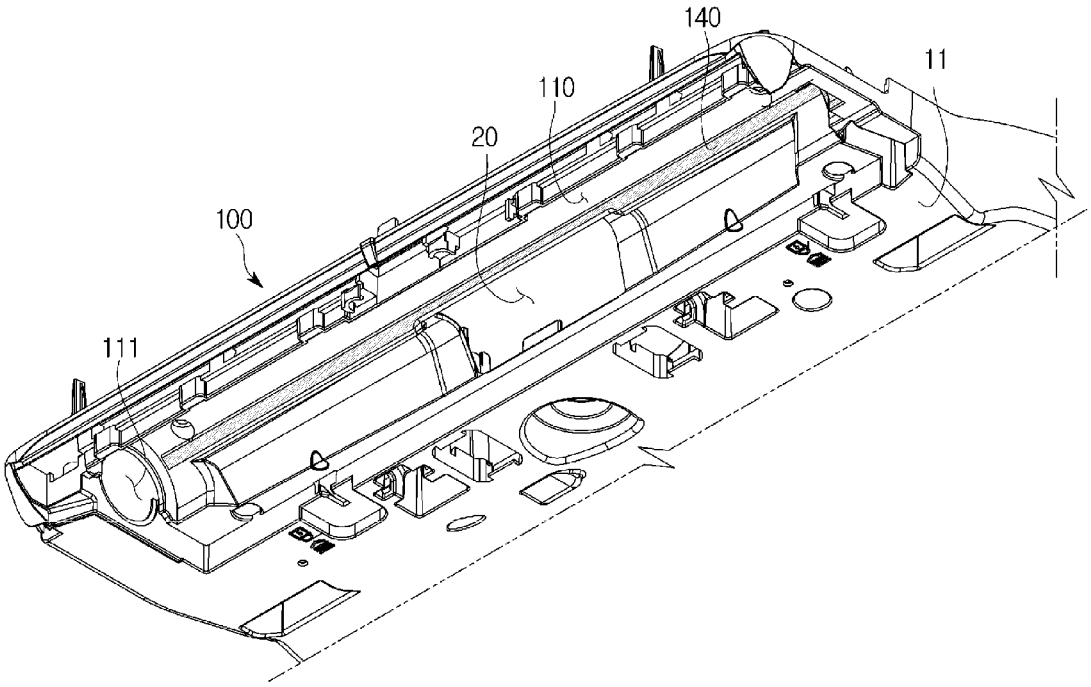
FIG. 7 is a view illustrating the cleaner according to the disclosure, which shows a friction member disposed in a brush chamber.
Figure 8:
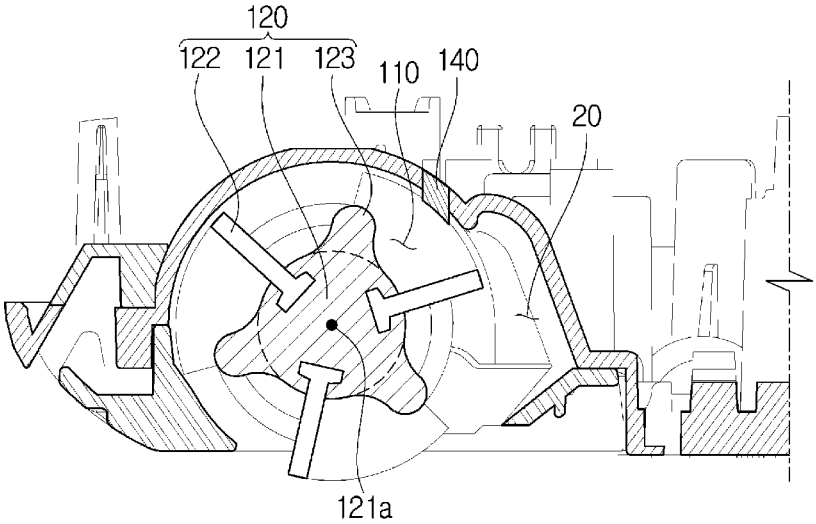
FIG. 8 is a view illustrating a cleaner according to the disclosure, which shows the inside of a suction device viewed from a lateral side.

FIG. 7 is a view illustrating the cleaner according to the disclosure, which shows a friction member disposed in a brush chamber. FIG. 8 is a view illustrating the cleaner according to the disclosure, which shows the inside of a suction device viewed from the side.

Referring to FIGS. 7 and 8, the suction device 100 may include a friction member 140 that is disposed on the brush chamber 110 and that allows a relatively small object to be cleaned, such as hair wound on the blade 122, to be separated from the blade 122 by a frictional force of contacting the blade 122.

The friction member 140 is disposed on the brush chamber 110 to come into contact with the blade 122. The friction member 140 may be disposed along the longitudinal direction of the brush body 121 to separate the object to be cleaned being wound around the blade 122 to the outside of the blade 122.

The friction member 140 may be provided in various shapes according to the shape of the intake 20 and the brush chamber 110. The friction member 140 is disposed adjacent to the intake 20, so that the object to be cleaned being separated from the blade 122 may be easily moved to the dust collecting device (not shown) by the suction force.

The friction member 140 may be disposed above the intake 20 while being adjacent to the intake 20. The friction member 140 may be disposed between the intake 20 and the rotation shaft 121*a* of the brush body 121.

The friction member 140 may have a friction force higher than a certain level. The friction member 140 may include a nylon material. The friction member 140 may be formed of fabric. However, the disclosure is not limited thereto.

Accordingly, the cleaner 1 according to the disclosure separates allows the friction member 140 to separate relatively small objects to be cleaned, such as hair wound on the blade 122, from the blade 122, and guide the separated objects to the intake 20, to thereby maintain the cleaning performance of the cleaner 1.

Hereinafter, a function of preventing the cleaning performance of the cleaner 1 from being lowered due to objects to be cleaned or foreign substance during drive of the cleaner 1 according to the disclosure will be described with reference to FIGS. 1 to 8.

The cleaner 1 may be provided with a maintenance station (not shown). The cleaner 1 may perform various cleaning tasks while driving autonomously. The maintenance station (not shown) is a type of maintenance device that may charge the battery of the cleaner 1 or empty the dust collecting device (not shown) of the cleaner 1.

The cleaner 1 may suction objects to be cleaned such as dust, during drive for cleaning, and discharge the objects during operation of a maintenance station (not shown).

The cleaner 1 may allow the controller 14 to manipulate the wheels 13 such that the cleaning zone is driven. The driving method may include zigzag driving, obstacle tracking, obstacle avoidance, or other various methods. The controller 14 may select an appropriate driving method based on signals of a sensor (not shown), and the like.

During drive for cleaning, the cleaner 1 may allow the brush 120 to sweep away objects to be cleaned, such as dust or debris accumulated below the cleaner 1. The dust collecting device (not shown) may store the objects to be cleaned being swept by the brush 120 or may suction and store the objects scattered by the brush 120.

After the cleaning is completed, the user may separate the dust collecting device (not shown), and remove the objects stored in the dust collecting device (not shown), or may connect the dust collecting device (not shown) to the maintenance station (not shown) for the objects stored in the dust collecting device (not shown) are automatically removed.

During drive for cleaning of the cleaner 1, objects to be cleaned, such as hair and the like and foreign substances, such as electric wires may be wound around the brush 120, and the cleaner 1 according to the disclosure may prevent the objects or foreign substance from being wound around the brush 1120 by mechanical configuration and electronic control.

As the mechanical configuration, first, the blocking member 131 and the connecting portion 130*c* may prevent relatively large foreign substance, such as electric wires, from being introduced into the brush chamber 110 during the drive for cleaning of the cleaner 1.

Next, the prevention member 123 prevents relatively large foreign substance introduced into the brush chamber 110 from being wound around the blade 122, and the grinder 150 may crush relatively small objects, such as hair, being wound around the groove portion 121*c*.

Then, the friction member 140 allows relatively small objects, such as hair, being wound around the blade 122 rather than around the groove portion 121*c* to be separated from the blade 122 through frictional force and guided to the intake 20.

Accordingly, the blocking member 131, the prevention member 123, and the friction member 140 may maintain the cleaning performance of the cleaner 1 in a mechanical manner, and the blocking member 131, the prevention member 123, and the friction member 140 as being mechanically constructed may minimize the rate of occurrence of failure.

The electronic control may be performed by the controller 14 when the cleaner 1 drives for cleaning. The brush 120 may be controlled to operate at a constant speed by the controller 14 to keep the cleaning performance of the cleaner 1 constant.

When cleaning a non-smooth floor surface, such as a carpet, the brush 120 may be rotated at a lowered speed compared to when cleaning a smooth floor surface. In this case, the controller 14 supplies more electric current or the like to rotate the brush 120 at a constant speed.

The controller 14 feeds back an electrical signal based on a sensor measurement capable of detecting an overcurrent or temperature rise of the brush motor (not shown), to provide the cleaner 1 with constant cleaning performance independent of obstacle factors.

For example, when an overcurrent is detected, the rotation of the brush 120 is reversed so that foreign substance wound around the brush 120 is released. In addition, the electronic control of the cleaner 1 according to the disclosure may complement the mechanical configuration.

The blocking member 131, the prevention member 123, and the friction member 140 may prevent an object to be cleaned or foreign substance, which is introduced into the brush chamber 110 from the front of the cleaner 1 during drive for cleaning, from being wound around the brush 120.

On the other hand, when the object to be cleaned or foreign substance is introduced from the rear of the cleaner 1, the controller 14 terminates operation of the brush motor (not shown) that transmits power to the brush 120 for a certain period of time to thereby reduce the rotational force of the brush 120, so that the cleaning performance of the cleaner 1 is prevented from being lowered due to the object to be cleaned or foreign substance being wound around the brush 120.

Although few embodiments of the disclosure have been shown and described, the above embodiment is illustrative purpose only, and the scope of the disclosure is not limited to the aforementioned embodiments.

It would be appreciated by those skilled in the art that changes and modifications may be made in these embodiments without departing from the principles and scope of the disclosure, the scope of which is defined in the claims and their equivalents.

[Industrial Applicability]

[Sequence Listing Free Text]

The invention claimed is:

1. A cleaner comprising:

a main body having an intake provided to suction an object;

a suction device having a brush chamber that communicates with the intake;

a brush accommodated in the brush chamber; and a brush base attachable to and detachable from a lower portion of the brush chamber to cover the brush chamber and to guide air to the intake, wherein the brush includes a brush body rotatably coupled to the brush chamber, a blade formed to protrude along a radial direction of the brush body, and prevention structures formed to be inclined from a central portion of the brush body to opposite side ends of the brush body to prevent foreign substance from being wound around the blade, wherein the brush base includes a base frame, a space portion through which the brush passes, and a connecting portion formed to extend inward from the base frame to partition the space portion, and wherein the brush body includes a groove portion provided at a central portion of the brush body so that the connecting portion is positioned in the groove portion and a grinder positioned between the groove portion and the brush base to cut debris suctioned into a space between the groove portion and the grinder.

2. The cleaner of claim 1, wherein the prevention structures are spaced apart from the blade at a same distance along a longitudinal direction of the brush body.

3. The cleaner of claim 1, wherein the prevention structures are arranged along a rotation direction of the brush body from the central portion of the brush body to the longitudinal direction opposite sides of the brush body.

4. The cleaner of claim 1, wherein the prevention structures protrude along the radial direction of the brush body at a height smaller than a height at which the blade protrudes along the radial direction of the brush body.

5. The cleaner of claim 1, wherein the prevention structures are arranged bilaterally symmetrical to the central portion of the brush body.

6. The cleaner of claim 1, wherein the blade is among a plurality of blades spaced apart from each other, and the prevention structures are arranged at a same distance from the plurality of blades arranged at opposite sides of the prevention structures and among the plurality of blades.

7. The cleaner of claim 1, wherein the prevention structures are formed of material having a rigidity greater than a rigidity of material forming the blade.

8. The cleaner of claim 1, wherein the prevention structures are formed of same material as material forming the brush body.

9. The cleaner of claim 1, wherein the brush base further includes a blocking structure having an inclined portion that is configured to block foreign substance from being introduced into the brush chamber.

10. The cleaner of claim 9, wherein the blocking structure is among a plurality of blocking structures spaced apart from each other, and the inclined portions of blocking structures adjacent to each other among the plurality of blocking structures are inclined in a same direction.

11. The cleaner of claim 10, wherein the inclined portions of the blocking structures adjacent to each other among the plurality of blocking structures are spaced apart from each other at a constant interval along a direction from a front surface of the brush base to a rear surface of the brush base.

12. The cleaner of claim 1, wherein the suction device further includes a friction structure arranged on the brush chamber to separate an object to be cleaned being wound around the blade using a frictional force of contacting with the blade.

13. The cleaner of claim 12, wherein the friction structure is arranged above the intake while being adjacent to the intake.

14. The cleaner of claim 12, wherein the friction structure is arranged along a longitudinal direction of the brush body.

15. The cleaner of claim 12, wherein the friction structure is arranged between the intake and a rotation shaft of the brush body.

* * * * *